US006786360B2

(12) United States Patent
Vogt et al.

(10) Patent No.: US 6,786,360 B2
(45) Date of Patent: Sep. 7, 2004

(54) DISPENSER

(75) Inventors: Reinhard Vogt, Dransfeld (DE); Duane B. Piechocki, Pleasanville, NY (US); Andreas Graus, Nörten-Hardenberg (DE)

(73) Assignee: Sartorius AG, Goettingen (DE)

( * ) Notice: Subject to any disclaimer, the term of this patent is extended or adjusted under 35 U.S.C. 154(b) by 189 days.

(21) Appl. No.: 10/194,191

(22) Filed: Jul. 12, 2002

(65) Prior Publication Data

US 2003/0019882 A1 Jan. 30, 2003

(30) Foreign Application Priority Data

Jul. 25, 2001 (DE) ..... 101 36 027

(51) Int. Cl.[7] ..... B65G 59/00; B65H 3/00; G06F 11/16

(52) U.S. Cl. ..... 221/268; 221/270; 221/236; 221/258

(58) Field of Search ..... 221/268, 270, 221/236, 258, 211

(56) References Cited

U.S. PATENT DOCUMENTS

| | | | | | |
|---|---|---|---|---|---|
| 2,465,876 | A | * | 3/1949 | Hornung | 221/72 |
| 3,047,347 | A | * | 7/1962 | Groves | 312/34.4 |
| 3,341,066 | A | * | 9/1967 | Bowes | 221/25 |
| 4,325,277 | A | * | 4/1982 | Uchida et al. | 83/205 |
| 4,573,607 | A | * | 3/1986 | Arrington et al. | 221/25 |
| 4,622,089 | A | * | 11/1986 | Lauritzen | 156/250 |
| 5,065,894 | A | * | 11/1991 | Garland | 221/25 |
| 5,335,817 | A | * | 8/1994 | Powers | 221/43 |
| 5,409,441 | A | * | 4/1995 | Muscoplat | 493/223 |
| 5,454,207 | A | * | 10/1995 | Storandt | 53/410 |
| 5,772,247 | A | * | 6/1998 | Legrand | 281/31 |
| 6,003,722 | A | * | 12/1999 | Thurner | 221/25 |
| 6,162,007 | A | * | 12/2000 | Witte | 414/416.01 |
| 6,375,034 | B1 | * | 4/2002 | Corbett | 221/46 |
| 6,718,740 | B2 | * | 4/2004 | Rivenbark et al. | 53/569 |

FOREIGN PATENT DOCUMENTS

| | | | | |
|---|---|---|---|---|
| DE | 3128547 A1 | * | 2/1983 | B65D/75/42 |
| EP | 0010744 A1 | * | 3/1994 | B65D/85/672 |
| EP | WO 0585145 A1 | * | 3/1994 | B65D/75/42 |
| EP | 1279603 A1 | * | 1/2003 | B65B/69/00 |

* cited by examiner

*Primary Examiner*—Donald P. Walsh
*Assistant Examiner*—Michael E Bulter
(74) *Attorney, Agent, or Firm*—Chernoff, Vilhauer, McClung & Stenzel, LLP

(57) ABSTRACT

A dispenser is disclosed that is particularly suitable for dispensing packaged items such as bandages or membrane filters. The dispenser is provided with a magazine for holding the items, with a distribution assembly for exposure and distribution of the items, an ejector operable in advance/feed and disposal modes, and with a separating assembly for separation of the item from its packaging.

16 Claims, 2 Drawing Sheets

DISPENSER

BACKGROUND OF THE INVENTION

Pursuant to 35 USC 120, the priority of DE 101 36 027.4 filed 25 Jul. 2001 is claimed.

Flat articles that are packaged aseptically, such as filter sheets or bandaging materials, are often used in the fields of microbiology, pharmacology and medicine. In order to make these articles available quickly and at any time in adequate quantities, the use of dispensers is known. Such packaged articles are generally enclosed in tube-shaped, sterile protective sleeves in the form of two foil strips. These protective sleeves can be spirally wound in a magazine of the dispenser or folded therein accordion style. Of primary importance during dispensation of such aseptic articles is the prevention of secondary contamination, caused, for example, by a hand touching the protective packaging which in turn comes into contact with the aseptically packaged item. To avoid such secondary contamination, the foil strips of the protective sleeve are pulled apart during an advance of the tube-shaped sleeve, for instance with a cutting, splitting or grasping assembly, so that the article is not exposed until it is ready for use, and then may be directly removed from the sterile packaging in a sterile manner, e.g., with forceps.

A major drawback of such a dispenser design is that intermediate reloading of the dispenser at any time is not possible because the entire rolled or folded sleeve must first be fully dispensed before the next one can be inserted. When reloading is possible, an entire sleeve containing fresh aseptic items must be introduced into the magazine of the dispenser and threaded through its advancing mechanism, which is time-consuming and labor-intensive. This is particularly disadvantageous when the supply available in the dispenser is used up at an inopportune moment, particularly when performing operations requiring performance without interruption.

A specific example of such a prior art dispenser is that disclosed in DE 298 05 100 U1, which includes means for opening a sleeve of protective packaging containing multiple membrane filters consisting of two longitudinal strips laminated together along their longitudinal edges. The two strips are peeled apart by winding them around each of two synchronized rolls driven in opposite directions. The synchronized rolls are coated with a rubber coating, which imparts the frictional force between the foils and the rubber coating necessary to separate the two foils of the sleeve. The packaging for the membrane filters is thus peeled away by the operation of the rolls in such a way that individual filters can be removed without having to touch either the protective packaging or the membrane filters by hand. However, reloading such a dispenser is relatively time-consuming because one end of the sleeve must be threaded through a guide and to an advancing mechanism and this can occur only when all the membrane filters in a rolled-up sleeve have been dispensed. In other words, the dispenser's magazine must first be fully emptied before it can be refilled.

Primary objects of the present invention are therefore (1) to improve such dispensers so as to enable them to be reloaded with minimal time expenditure, and (2) to impart flexibility with respect to the timing of reloading.

BRIEF SUMMARY OF THE INVENTION

These objects are achieved by the provision of a dispensing apparatus having a magazine ejector for holding a multiplicity of single packaged items in protective packaging for the dispensation of the single packaged items, and a separating assembly for the separation of the protective packaging from each packaged item. The packaging layers of a single packaged item are separated during dispensation by the separating assembly of the dispenser, so that an aseptic item such as a membrane filter that has been exposed can be removed without coming into contact with non-sterile components, thereby preventing secondary contamination.

Because the dispenser can dispense single packaged items from a magazine, the dispenser's magazine can be loaded with stacks of single packaged items and reloaded in a simple manner and at virtually any time during operation of the dispensing apparatus, meaning processing operations in progress will not be delayed. Troublesome and time-consuming threading of a packaging sleeve into an advancing mechanism is thus avoided. Reloading is possible even when the stack of packaged items in the magazine is not yet fully used up. Operation of the dispenser is therefore very flexible, which makes its use in all applications more efficient.

DETAILED DESCRIPTION OF THE PREFERRED EMBODIMENTS

Figure 1:
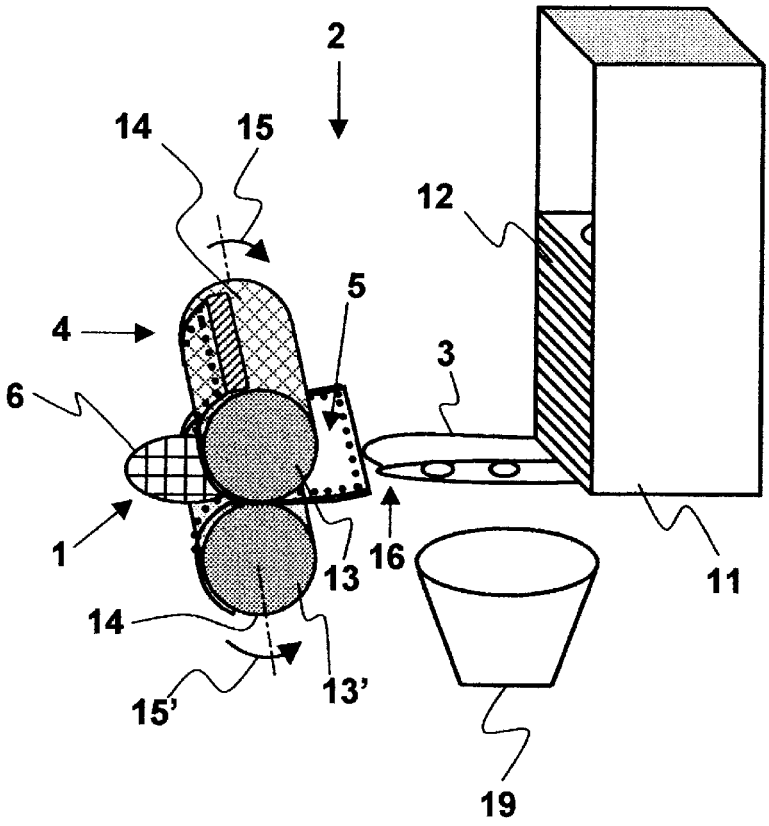
FIG. 1 is a schematic perspective view of an exemplary dispenser of the invention in the advancing/feed mode.
Figure 2:
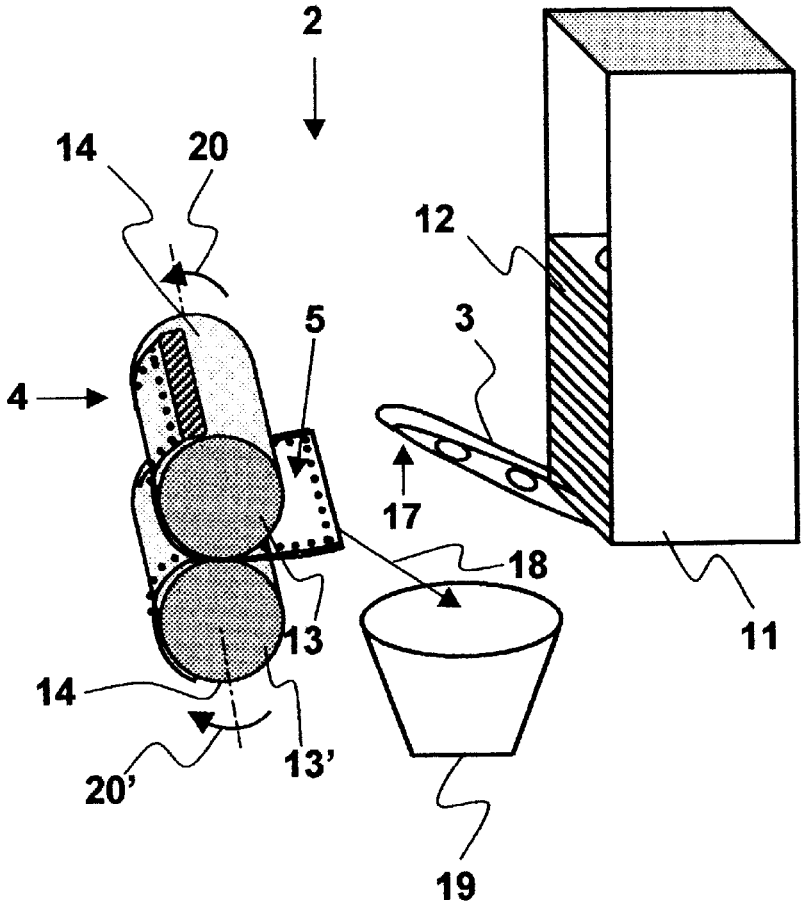
FIG. 2 shows the dispenser of FIG. 1 in a packaging disposal mode after the removal of the packaged item.

Referring to the drawings, wherein like numerals refer to the same elements, there is shown in FIGS. 1 and 2 an exemplary dispenser apparatus of the invention comprising single packets 1 in a magazine 11, a dispensing assembly 2 provided with an ejector 3 for the distribution of single packets 1 and a separating assembly 4 for separating package cover 7 from package base 8 of a protective packaging 5 containing, e.g., an aseptically packed membrane filter 6.

Figure 3:
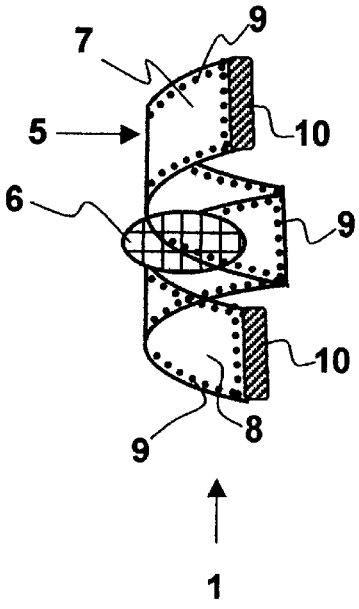
FIG. 3 is a schematic of an opened single packaged item.

Single packets 1 preferably comprise protective rectangular packaging 5, made up of a package cover 7 and a package base 8, together forming a protective sheath around a disk-shaped membrane filter 6. Preferably cover 7 and base 8 are in the form of transparent sheets. Prior to enclosure of membrane filter 6, the internal surfaces of protective packaging 5 are sterilized to protect the filter from contamination. Cover 7 and base 8 may be hermetically sealed by an adhesive bond of adhesive surfaces 9, best seen in FIG. 3. On one of the front sides of protective packaging 5 is a flap 10 on each cover 7 and base 8 which facilitates their separation.

A stack 12 of single packets 1 is located in magazine 11. Magazine 11 is provided with an ejector 3, which can be adjusted alternatively to advance/feed position 16 and to packaging disposal position 17. In the advance/feed position 16, ejector 3 delivers each single packet 1 from the magazine 11 to separating assembly 4. In disposal position 17, ejector 3 clears a path for the opened protective packaging to be discarded into disposal container 19.

Dispensing assembly 2 is equipped with two counter-rotating rolls 13, 13' which can be driven by a driving gear (not shown) in operative engagement with an electric motor (not shown). Rolls 13, 13' are arranged parallel to their longitudinal axes. A gap between rolls 13 and 13' is selected in so that a single packet 1 can be passed between them with a predetermined clamping pressure sufficient to transfer driving torque from the rolls to packet 1. Advantageously, the surfaces of the rolls are provided with a coating layer, e.g., of rubber, which creates a high coefficient of friction between cover 7 and base 8 of protective packaging 5 and the surfaces of the rolls.

In the exemplary embodiment depicted in FIGS. 1 and 2, separating assembly 4 includes a vacuum 14 provided by a vacuum source (not shown) which is in fluid communication with rolls 13, 13' via ducting (not shown). The surfaces of rolls 13 and 13' are covered by a grid through which dust and other particulates can be vacuumed from the entire surface of both rolls by application of the vacuum.

In order to deliver a membrane filter 6, ejector 3 is operated in a first operating sequence by an electrical switch (not shown) or by a mechanical lever (not shown) in the case of a mechanical driving gear. A single packet 1 is then delivered from ejector 3 from the bottom of stack 12 in magazine 11 and conveyed to rolls 13, 13' so that the rolls grasp the single packet 1. An electric motor drive then may be used to set into motion counter-rotating rolls 13, 13'.

During a second operating sequence rolls 13, 13' are rotated in their forward direction 15, 15', thereby advancing single packet 1 between rolls 13, 13'. Through application of vacuum 14, package cover 7 and package base 8 of protective packaging 5 are pressed onto the surfaces of rolls 13, 13'. With further counter-rotating movement of rolls 13, 13', cover 7 and base 8 are separated when the adhesive force between them is overcome, and membrane filter 6 is exposed; this occurs when the force of the suction between the surfaces of rolls 13, 13' on the one hand, and cover 7 and base 8 on the other is greater than the adhesive force binding cover 7 to base 8. The counter-rotation of rolls 13, 13' is then stopped in a terminal position, exposing membrane filter 6 sufficiently to remove it without touching it by hand, e.g., with forceps, while at the same time not permitting it to fall out of the opened protective packaging 5.

A third operating sequence serves to dispose of the opened protective packaging 5 after removal of membrane filter 6. The direction of the rotary drive of rolls 13, 13' is reversed so that they are rotated in the backward rotational directions 20, 20'. Ejector 3 is simultaneously brought into disposal position 17 and application of vacuum 14 is interrupted so that the surfaces of the opened protective packaging 5 is released from rolls 13, 13'. Upon additional rotation in the directions 20,20', opened protective packaging 5 is discarded along the general path 18 into disposal container 19. Separating assembly 2 then returns magazine ejector 3 to its advance/feed position 16 in readiness for the retrieval and dispensation of the next single packet 1.

In an especially preferred embodiment of the invention, the dispenser is provided with at least two of the counter-rotating rolls 13, 13' for grasping, transporting and exposing the single packaged items. The counter-rotating rolls 13, 13' are particularly suitable for a dispenser equipped with separating means for separation of two layers of protective packaging from the item to be dispensed. The individual protective packaging is guided with a predetermined clamping pressure through a clearance between the counter-rotating rolls. At that point, separating means which are in operative connection with the counter-rotating rolls grasp both layers of the protective packaging and separate them from each other in cooperation with the advancing feed of the counter-rotating rolls.

In a particularly preferred embodiment of the invention, the separating means comprises a vacuum applied to the surface of each of the counter-rotating rolls, which is particularly effective in separating the protective packaging layers. The vacuum is preferably applied over the entire surface of each of the counter-rotating rolls, thereby causing the two layers of the protective packaging to each adhere to the surface of a roll so as to separate them from each other by the counter-rotation of the rolls. It is also possible to provide each of the rolls with a narrow gap extended over their entire width and to apply a vacuum to the gap. The rolls are thus operated in a synchronized manner in such a way that the gap will be located opposite the protective packing at a certain point in time so that the vacuum will be applied to the two layers of the protective packaging at the same time.

In another preferred embodiment of the invention, at least one of the counter-rotating rolls is provided with a lateral guide. When a lateral guide is used with the rolls, each packaged item can be more precisely positioned so that the separating force is applied in exactly the same position for each, which increases the safety of the dispensing apparatus.

In yet another preferred embodiment of the invention, the separating means is in the form of at least one splitter element preferably connected to each of the counter-rotating rolls and adapted to engage for example one end of either a cover layer or a base layer of the protective packaging so that the two layers are pulled apart from each other during rotation of the rolls. Splitter elements which are used independently of the counter-rotating rolls are also possible.

In still another preferred embodiment of the invention, the counter-rotating rolls are provided with heating means capable of dissolving an adhesive layer between the two layers of the protective packaging so as to enable easier separation of the layers. Heating means can be particularly advantageous when combined with the application of a splitter element or a vacuum.

In yet another preferred embodiment of the invention, the separating means is provided with at least one cutting element. Cutting elements can be employed with advantage as a supporting element together with a splitter element or with a vacuum. Cutting elements preferably cut the protective packaging first at its front face which is located opposite the magazine ejector, and then along its longitudinal sides. In an exemplary operating sequence of a separating apparatus, the two protective packaging layers are separated from each other by a splitter element or by the application of vacuum in the longitudinal direction. Cutting elements simplify this separating operation in such a way that the splitting force of the splitter elements or the suction force of the vacuum can be reduced, which can reduce energy costs.

In yet another preferred embodiment of the invention, at least one of the counter-rotating rolls is driven by a gear that is in turn driven either manually or by a motor. At least one of the rolls can be also driven by an electric motor.

Both rolls can be provided with their own driving gear; however it is also possible that only one of the rolls has an active driving gear and the second roll is driven by the first one with the application of a clamping pressure, or driven indirectly by the first roll or with a connected drive.

In yet another preferred embodiment of the invention, the protective packaging around the item to be dispensed is provided with at least one flap. Flaps are preferably arranged on both layers of the protective packaging, and facilitate opening of the packaging layers, particularly when splitter elements are used, for example, with gripping devices which are engaged by the flaps.

As noted above, the magazine ejector can be assigned both a feed position for advancing and distributing the packaged items and a discharge position for disposing of the empty protective packaging after extraction of the packaged item. In the discharge position of the magazine ejector, access to a disposal container is cleared and the rotation of the rolls can be reversed to discharge the empty protective packaging into the disposal container. The disposal container can be either integral with the dispenser apparatus or external thereto.

In another preferred embodiment of the invention, the dispensing apparatus is constructed in such a way that a plurality of packaged items can be dispersed simultaneously. If a particularly high dispensation rate is required for the distribution of, e.g., membrane filters, the dispenser can be provided with a wider distribution assembly capable of grasping several single packaged items simultaneously from a magazine accommodating several adjacent stacks of filters.

Preferably, the protective packaging has a rectangular shape, making it particularly suitable for engagement with cutting and splitter elements for separating layers of packaging.

In yet another embodiment of the invention, the ejector can be driven and controlled by the driving gear of the counter-rotating rolls, making it possible to coordinate the movement of the rolls with that of the ejector via a common driving gear, which in turn coordinates control over the exposure and distribution of the filter by a common driving gear. A cost-effective and particularly compact construction form of the dispenser can thus be achieved in this manner.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A dispenser for a multiplicity of packaged items that are substantially flat and packaged in single packets of protective packaging, said protective packaging comprising a package base sealed to a package cover that can be at least partially separated in order to expose said packaged items wherein said dispenser is provided with a magazine for containing a stack of said single packets and with dispensing means for the exposure and dispensation of said packaged items, wherein said dispensing means is equipped with an ejector for the distribution of said single packets and with separating means for the separation of said package cover and said package base from each packaged item, wherein said dispensing means includes at least two rolls rotatable in opposite directions and said separating means comprises a vacuum in fluid communication with said rolls.

2. The dispenser of claim 1 wherein said vacuum is in fluid communication with the entire surface of each of said rolls.

3. The dispenser of claim 2 wherein at least one of said rolls is provided with a lateral guide integral with at least one of said rolls.

4. The dispenser of claim 1 wherein said separating means comprises a splitter element.

5. The dispenser of claim 1 wherein at least one of said rolls is provided with at least one heating element.

6. The dispenser of claim 1 wherein said separating means includes at least one cutting element.

7. The dispenser of claim 1 wherein at least one of said rolls is driven by a gear.

8. The dispenser of claim 7 wherein said ejector is controlled by said gear.

9. The dispenser of claim 1 wherein at least one of said rolls is driven by an electric motor.

10. The dispenser of claim 1 wherein said ejector is operable in both (a) a feeding position for feeding said protective packaging to said separating means; and (b) a disposal position for disposing of said protective packaging following removal of said packaged items.

11. The dispenser of claim 10 including a disposal container.

12. The dispenser of claim 11 wherein said protective packaging is fed to said disposal container following removal of said packaged items.

13. The dispenser of claim 11 wherein said disposal container is integral with said dispenser.

14. The dispenser of claim 11 wherein said disposal container is external to said dispenser.

15. The dispenser of claim 1 wherein said dispensing means is capable of dispensing a plurality of said packaged items simultaneously.

16. The dispenser of any of claims 1 or 2–15 wherein said packaged item is a filter.

* * * * *